US007326132B2

(12) United States Patent
Olexa

(10) Patent No.: US 7,326,132 B2
(45) Date of Patent: Feb. 5, 2008

(54) LACROSSE SHOOTING RANGE AND SUPPORTING MECHANISMS

(76) Inventor: Christopher M. Olexa, 4019 Rosemeade Dr., Fairfax, VA (US) 22033

( * ) Notice: Subject to any disclaimer, the term of this patent is extended or adjusted under 35 U.S.C. 154(b) by 29 days.

(21) Appl. No.: 11/357,719

(22) Filed: Feb. 17, 2006

(65) Prior Publication Data

US 2006/0199675 A1 Sep. 7, 2006

Related U.S. Application Data

(60) Provisional application No. 60/653,698, filed on Feb. 17, 2005.

(51) Int. Cl.
*A63B 69/00* (2006.01)
*A63C 19/00* (2006.01)
*A63C 19/10* (2006.01)

(52) U.S. Cl. ..... 473/446; 473/415; 473/478; 472/92

(58) Field of Classification Search ..... 473/446, 473/478, 421, 422, 415, 432, 459; 472/88, 472/90–92

See application file for complete search history.

(56) References Cited

U.S. PATENT DOCUMENTS

| | | | | |
|---|---|---|---|---|
| 3,709,489 | A * | 1/1973 | Holleran et al. | 473/446 |
| 3,765,675 | A * | 10/1973 | DiMarzio | 473/446 |
| 4,607,842 | A * | 8/1986 | Daoust | 473/446 |
| 5,509,652 | A * | 4/1996 | Woronets | 473/446 |
| 6,059,673 | A * | 5/2000 | Mason | 473/478 |
| 6,966,853 | B1 * | 11/2005 | Wilkerson et al. | 473/446 |
| 7,104,901 | B1 * | 9/2006 | Mason | 473/446 |

* cited by examiner

*Primary Examiner*—Mitra Aryanpour
(74) *Attorney, Agent, or Firm*—Mark A. Wurm

(57) ABSTRACT

A system and supporting mechanisms for practicing the art of shooting at a lacrosse goal maximizes the area to practice running and shooting movements, while minimizing the area required doing so, while best representing the field's dimensions. The invention comprises simple structures, uniquely optimized complex structures and specifically designed mechanisms for lacrosse skill practice that is utilized within the structures. A rectangular alley is formed by a ball retaining material having a front, rear and side walls. The alley has sufficient width and height to permit easy shooting by a player of a lacrosse ball into a rotationally moveable goal which presents various angles of goal openings to the player shooting.

14 Claims, 8 Drawing Sheets

LACROSSE SHOOTING RANGE AND SUPPORTING MECHANISMS

CROSS-REFERENCE TO RELATED APPLICATIONS

This application claims the benefit of U.S. Provisional Patent Application No. 60/653,698, filed Feb. 17, 2005, entitled "Lacrosse Shooting Range and Supporting Mechanisms" by Christopher M. Olexa. The teachings of the provisional patent application are incorporated herein by reference in their entirety.

FIELD OF THE INVENTION

The invention relates to a novel system and mechanisms for providing practice of the art of shooting a lacrosse ball into a lacrosse goal.

BACKGROUND OF THE INVENTION

Lacrosse is a popular game wherein players move a ball with a stick that has a net pocket at one end. The object of lacrosse is to score a goal by throwing, scooping or kicking a solid rubber ball into the opposing team's goal. There is not an efficient way for individuals to practice the art of shooting a lacrosse ball into a lacrosse goal. During a shot, the ball travels great distances and at high velocities, and because of this, players and property are at risk of being hit. It is also very time consuming to look for lost balls and chase missed shots. Due to the rapid growth of the sport and the requirements for large amounts of space, the following solution to practice shooting has been created to meet these needs and to provide an efficient training environment for lacrosse players.

SUMMARY OF THE INVENTION

The solution requires that structures and mechanisms be built that maximizes the area to practice running and shooting movements, while minimizing the area required to do so, while best representing the field's dimensions. The invention comprises simple structures, uniquely optimized complex structures and specifically designed mechanisms for lacrosse skill practice that is utilized within the structures. In an embodiment of the invention a rectangular alley is formed by a ball retaining material having a front, rear and side walls. The alley has sufficient width and height to permit easy shooting by a player of a lacrosse ball into a rotationally moveable goal which presents various angles of goal openings to the player shooting.

DETAILED DESCRIPTION OF THE INVENTION

When describing the invention the term "range" is defined as a structure that contains alleys for lacrosse practice shooting. An "alley" is defined as an area that is segmented to allow a player or players to practice lacrosse skills. The lacrosse ball is a regulation ball sanctioned for playing lacrosse into a regulation goal.

Figure 1:
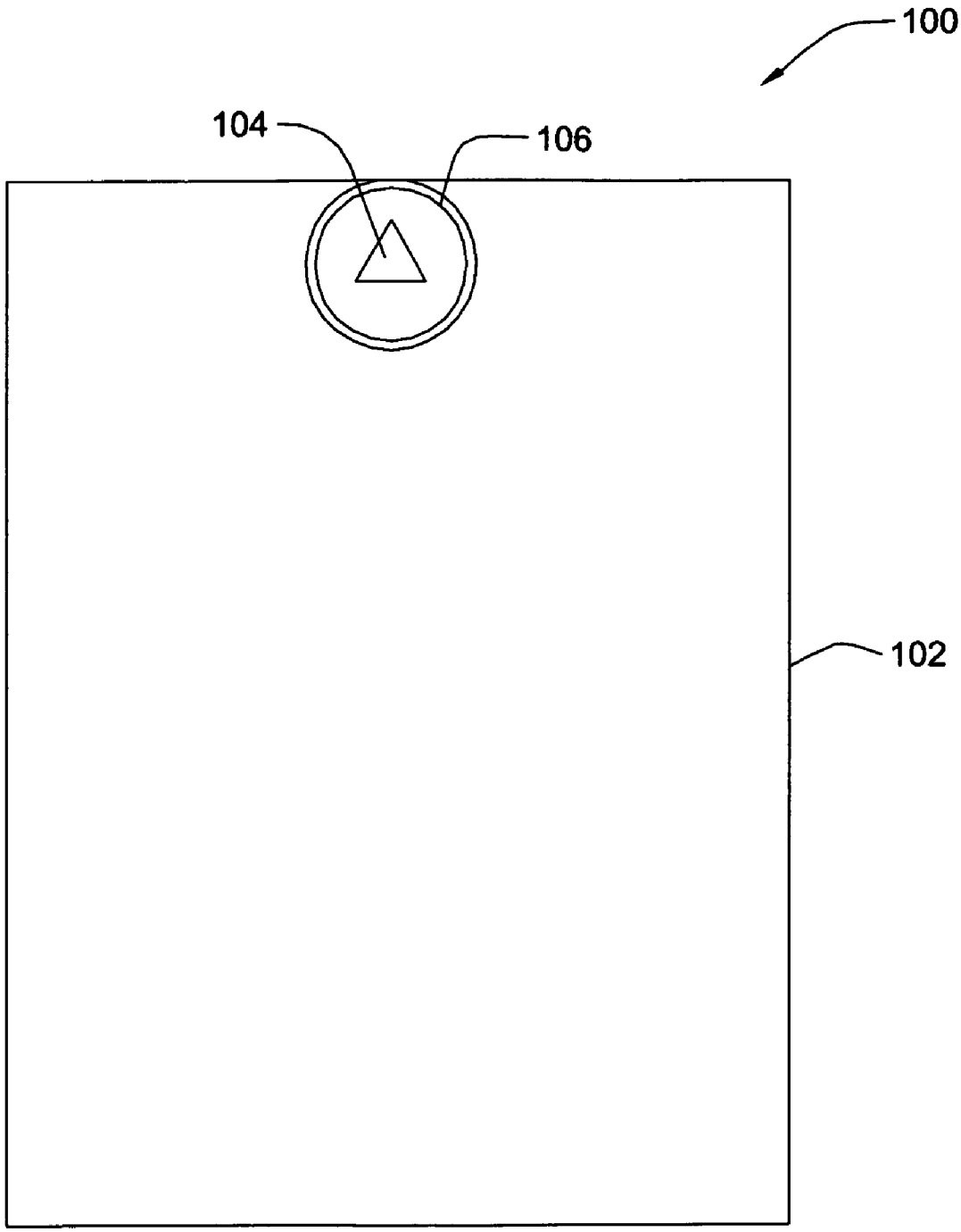
FIG. 1 illustrates a simple structure for embodying the invention.

The first embodiment of the invention is a simple structure as shown in FIG. 1. A simple structure is defined as rectangular or square in shape. Typical buildings are built with such shapes and are typically constructed 100 feet in depth. The alley, 100, is surrounded by netting, 102, or some other material that separates the alleys on the sides and also hangs in the front and rear. Multiple alleys 100 may be positioned back to back to form a structure having many lacrosse practice ranges. However, if the alleys are situated in an opposing configuration the alleys can better utilize space by creating a central walkway for accessing the alleys. Typical heights of these structures are between 18-30 feet but some may be greater or less than that height. The alley netting or other material will allow the separations to be moved such that the field can be opened up for full use or for changes in alley configuration.

Shown within the alley is a goal 104 shaped as a triangle. Surrounding the goal 104 is a circle 106 called a goal crease. This region is 5.5 meter in diameter and defines the goal area where a goalkeeper may touch or bat a lacrosse ball with their hands.

Future expansion can be built into the design of the structure to allow for the addition of one or more additional levels built on top of the initial structure. This will also allow for greater utilization of the land.

Figure 2:
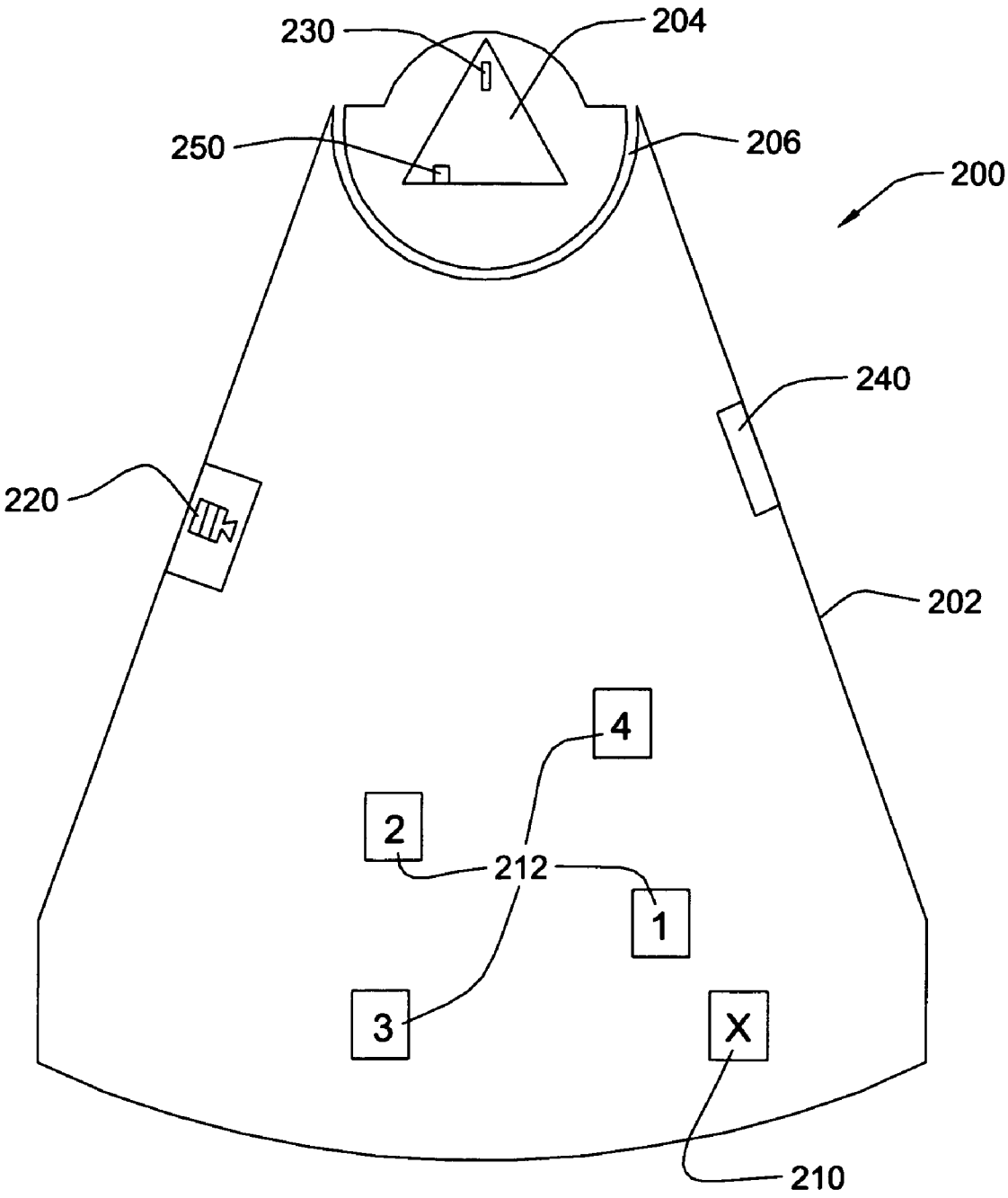
FIG. 2 illustrates a portion of a complex structure for embodying the invention.

The next range structures are complex structures as shown in FIG. 2. Complex structures, 200, are defined as polygonal or circular in shape. This configuration highly optimizes the space required and allows the most room for the player to practice his movements. This is the preferred configuration for the range. Again a fabric, fence or wall material 202 forms the outer edge of the alley. A goal 204 and the goal crease 206 are shown.

Figure 3:
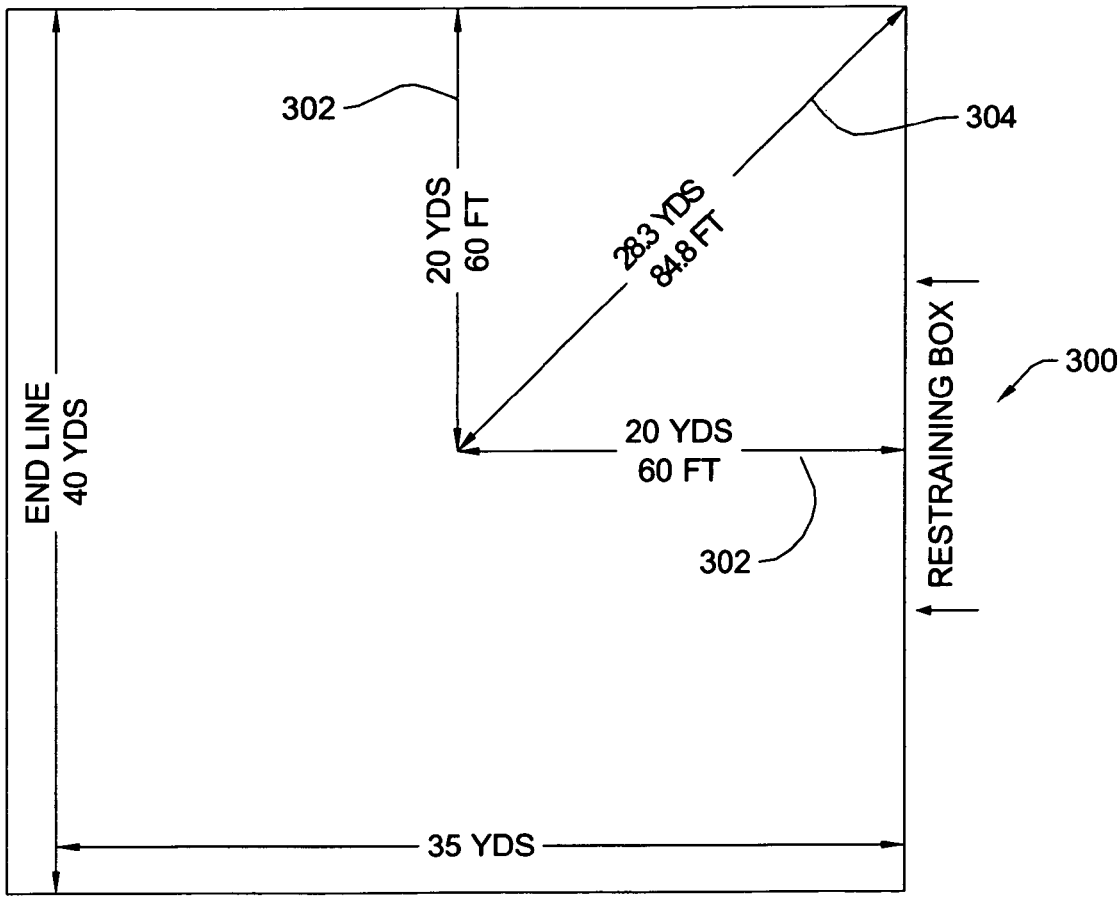
FIG. 3 illustrates a preferred configuration for a lacrosse range.

The sector-segmented alleys 200 allow for significant space for the players to move and also allow for the most accurate dimensional relationship to the field space. Shown in FIG. 3 is the defensive area 300 of a lacrosse field. The area is 40 yards by 35 yards with the goal positioned 20 yards from the front and side of the defensive area as shown by reference numeral 302. The maximum shot distance that can be achieved using a 40 yard end line and a 20 yard restraining box. The calculating the maximum shot distance is 84.8 feet to the goal as shown by reference numeral 304.

Figure 4A:
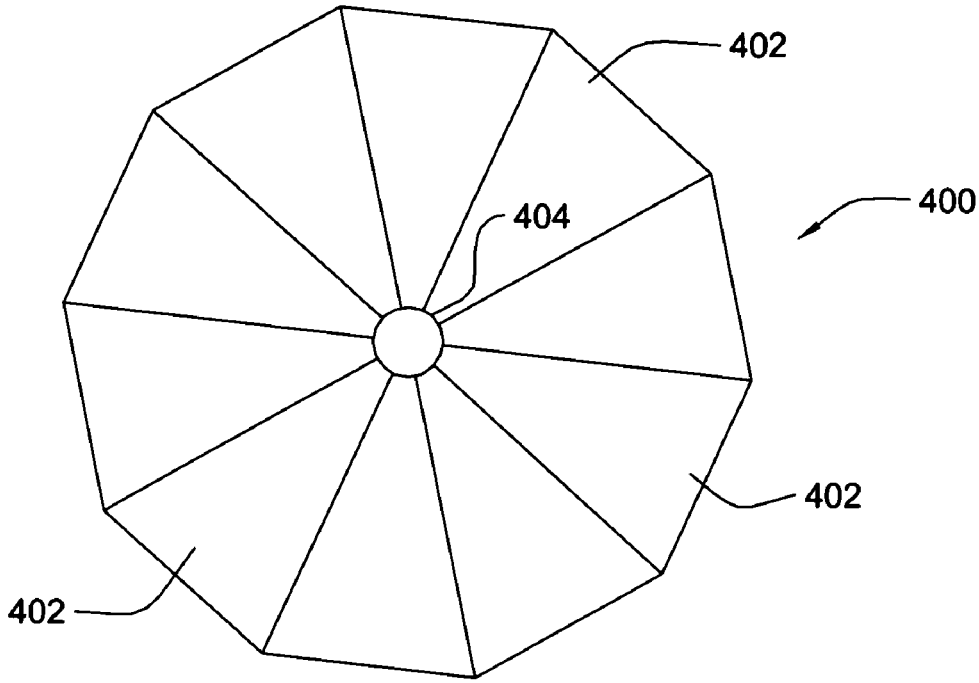
FIGS. 4*a* and 4*b* illustrate top and side view of a possible layout for a complex range.

The complex structure is designed to allow for a central ball collection mechanism for automated bail return. Such a structure 400, is shown in FIG. 4*a* and has optimal dimensions for this structure is one with an outer radius of greater than 19.5 meters or 64 feet, 4.57 meters or 15 foot inner radius for collection and central support structure and 36 degree arcs to segment the alleys, 402. The circumference based on the inner radius 404 cannot be any smaller than 2.13 meters or 7 feet for a sector as this will not leave enough room for a regulation goal.

Figure 4B:
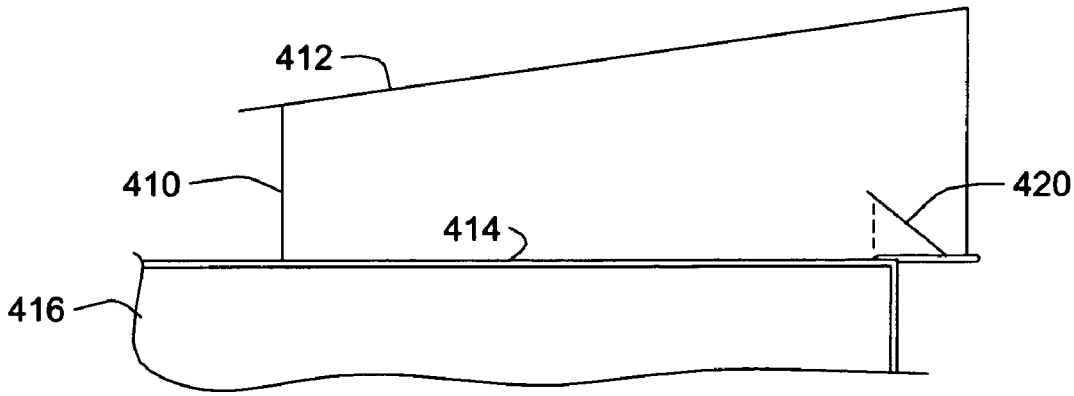

Shown in FIG. 4*b* is a cross-sectional side view of any alley 402. The outer wall 410, roof 412, playing surface 414, and goal 420 make up the alley. The alley rests on a solid support base 416 such as concrete.

Figure 5A:
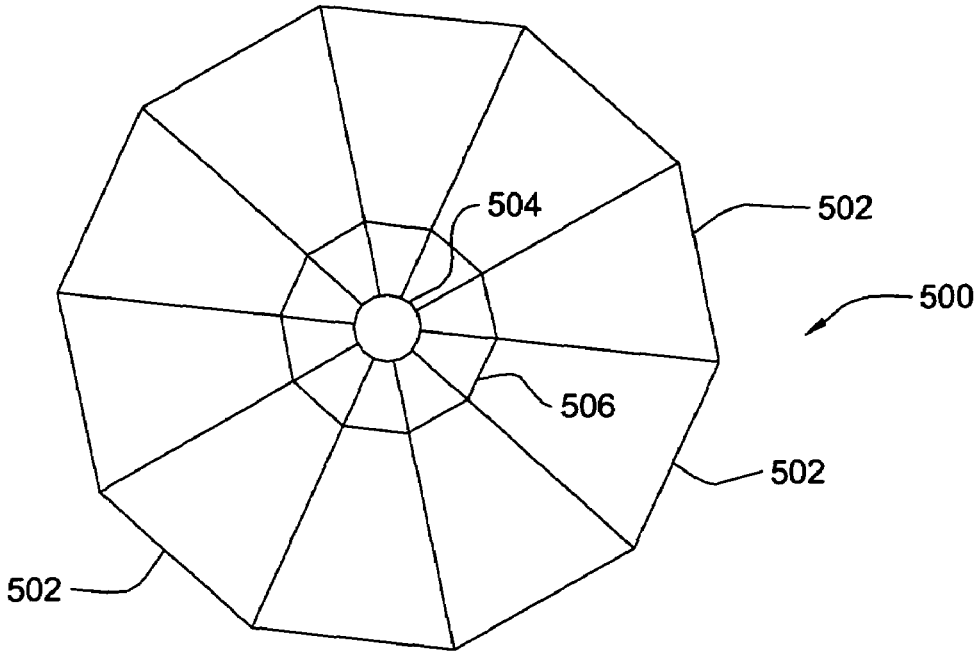
FIGS. 5*a* and 5*b* illustrate top and side view of another possible layout for a complex range.
Figure 5B:
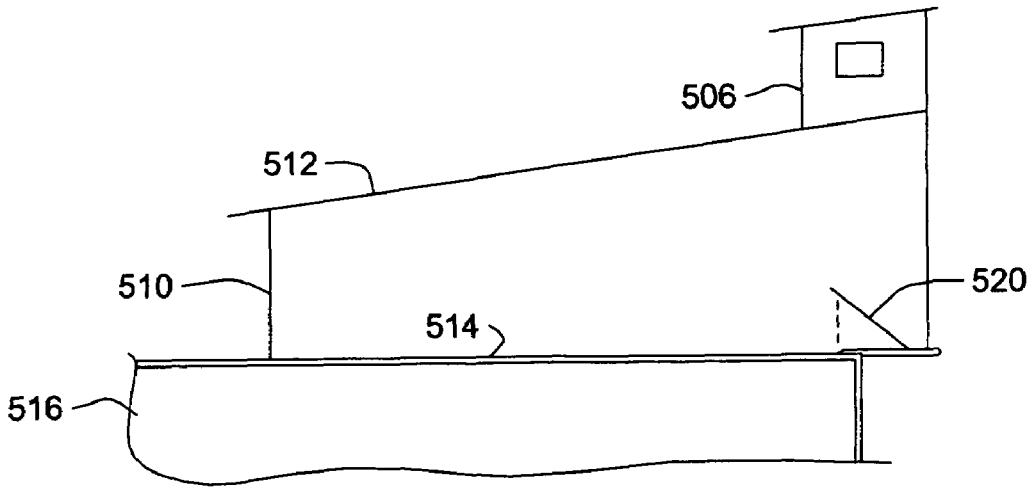

Future expansion can be built into the design of the structure to allow for the addition of one or more additional levels built on top of the initial structure. A multiple level range is shown in FIG. 5*a* wherein a range 500 has multiple alleys 502. An inner radius 504 defines the region where a goal may be placed. A viewing area 506 is positioned above the lower alleys 502. A multiple level will also allow for greater utilization of the land. Instead of just a viewing area, a vertical stacking of alley can be made to form a true multiple level range. Shown in FIG. 5*b* is the outer wall of an alley 510, roof 512, and playing surface 514. Goal 520 is shown positioned in alley 502. The alley rests on support base 516 which may be concrete.

Figure 6:
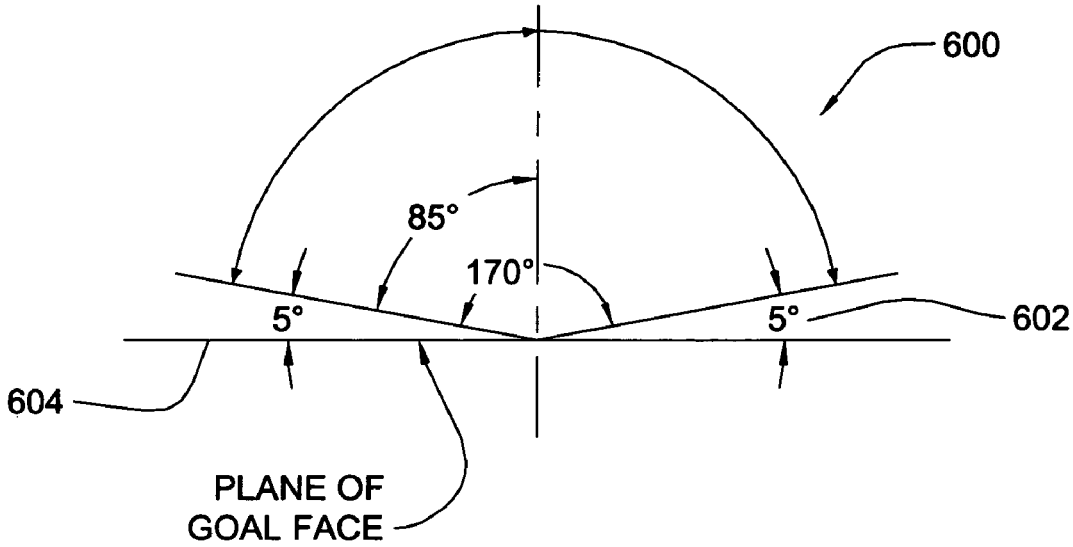
FIG. 6 illustrates a lacrosse goal according to the invention.

The invention provides a lacrosse range mechanism having a novel rotational goal to give a player the most extensive ability to practice their shooting skills. To do so a player needs nearly 270 degrees of angle to shoot on goal. While the goal face 604 allows for nearly 170 degrees to reach it's maximum to allow a ball to clear the goal plane, lacrosse players will almost always be running requiring access to the angles greater than the 170 degrees. To accomplish this in constrained spaces to run, the goal will rotate. This is shown as 600 in FIG. 6. Five degree of rotation is maintained for clearance of the ball diameter 602. The remaining arc is 85 degrees off center for a total of approximately 170 degrees of rotation. This concept allows the larger degree sweep to be accomplished without requiring need for the additional space.

Figure 7:
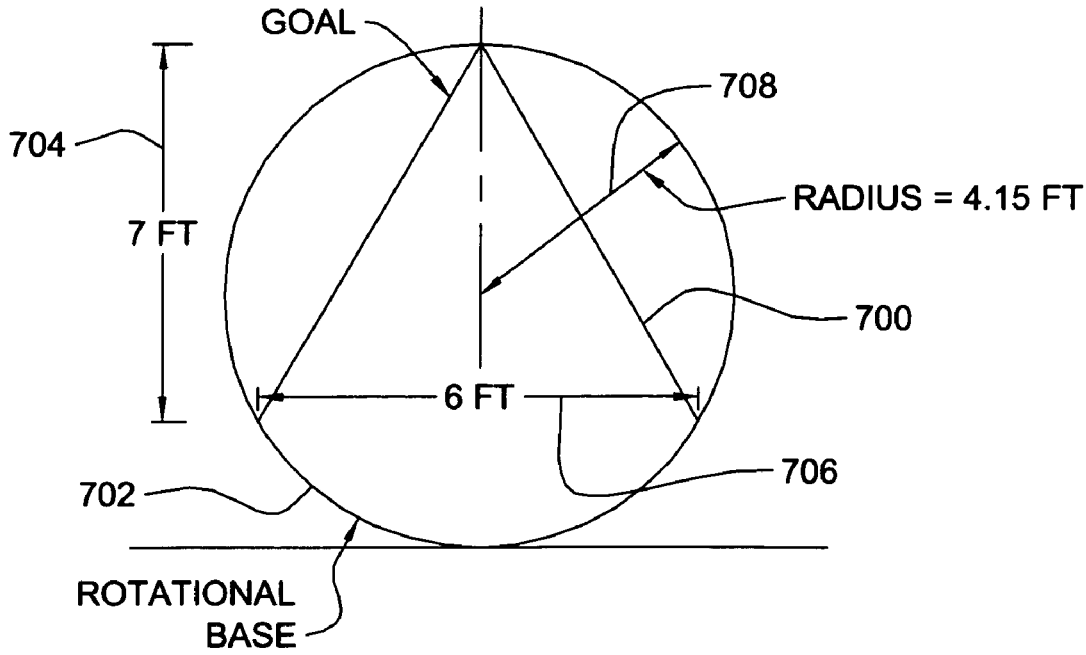
FIG. 7 illustrates a top view of a goal according to the present invention.

The base of the goal 700 rests on a rotational disk or base 702 that can be controlled by a remote controller, a hand crank or preferably can be driven by an electric motor. This is illustrated in FIG. 7. The depth of the goal is 7 feet, 704, the front face of the goal is 6 feet, 706, which together form a 4.15 foot radius 708. The rotational base controller will be able to allow the player to select any angle with the 170 degrees of travel, select set angles that may be optimized for a player's practice position, or controlled by computer for random or patterned rotational movements.

Figure 8A:
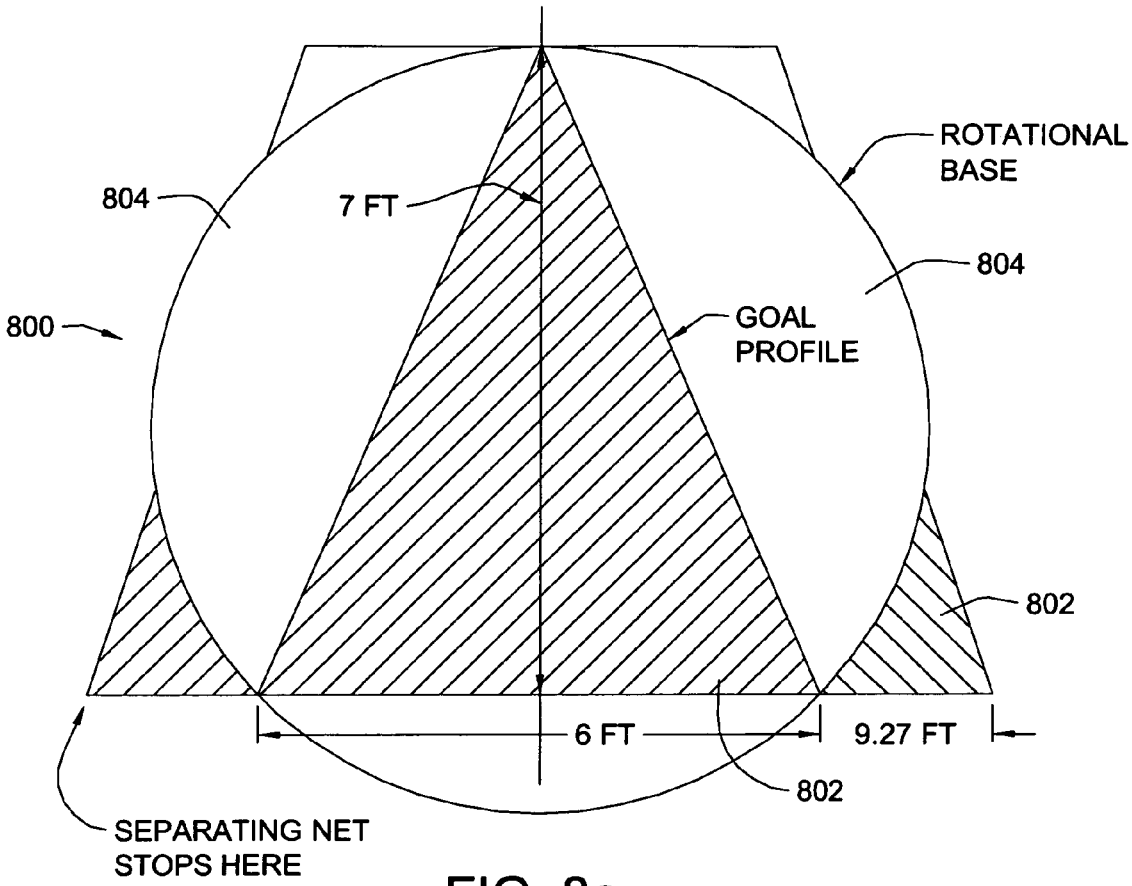
FIG. 8*a* illustrates the rotation base of the goal.
Figure 8B:
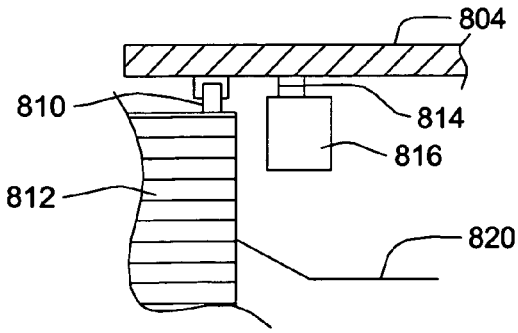
FIG. 8*b* illustrates a gear drive mechanism of the rotation goal according to the present invention.

When used with the complex structures, the rotational base will allow for balls to drop below to a collection area. This is shown in FIG. 8*a* where the rotational goal 800 has openings 802 to a collection area 820 below shown in FIG. 8*b*. The remainder of the goal floor area 804 is beveled or angled to force lacrosse balls to roll to openings 802. The rotational base can be used in conjunction with any of the structures. It can be implemented with or without ball collection. For the ball collection capability to be implemented, an area specifically matching the inside dimensions of the top down profile of the goal will be cut out. The cut out will allow balls to drop to the collection area 820 which may have various gathering and return mechanisms for the balls.

The rotational base 804 will be at least 8.3 feet in diameter but may be larger and will rest atop a mechanism such as a skate wheel 810 or the like to reduce friction to allow free rotation to occur via drive mechanism 814 which may be a gear being driven by an electric motor 816. The rotational base is supported by a solid foundation 812 which may be concrete, steel or the like. Ta the ball collection scenario, the rotational base's top surface may be slightly angled to allow balls to roll off the base into the collection area below. The base may be covered with the same surface covering as the rest of the alley. The support 814 of the rotational goal in the collection scenario may be suspending by supports underneath that may be constructed by steel, masonry, or wood. This would allow the base to be supported at the same plane as the field but allowing the balls to drop to to collection area below.

It is noted that a regulation goal is not required for this mechanism. Any structure that emulates the goal can be used in conjunction with the rotational base. Shots missed or made in the goal will fall into a collection area below and behind the goal. It is expected that the lacrosse ball return has a collection area 820 that will then direct the balls to a central chute that will allow the balls to be funneled or carried back to a central area to place the balls back into play. Alternatively, the balls can be collected and carried in the practice alley by a player.

Figure 9A:
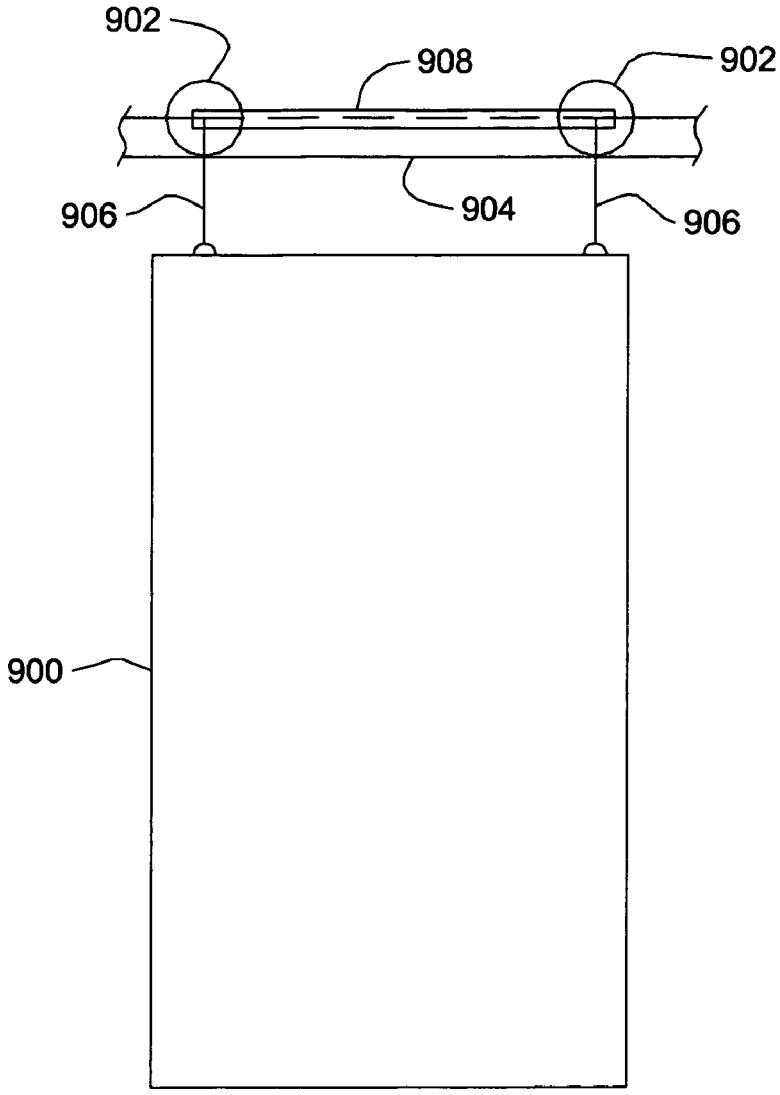
FIGS. 9*a* and 9*b* illustrate front view and side views, respectively, of a moveable throwing wall for use with in conjunction with a lacrosse goal.
Figure 9B:
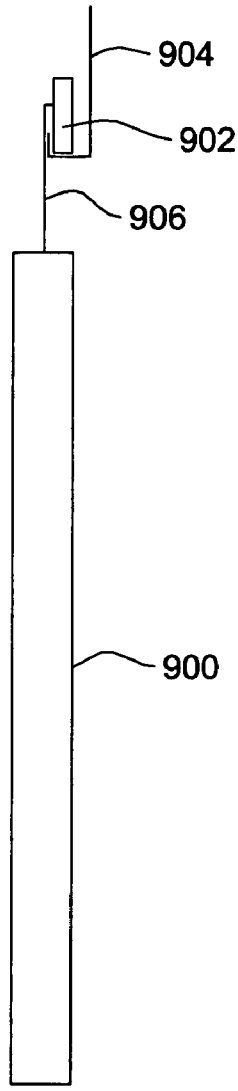

A throwing wall, FIGS. 9*a* and 9*b*, allows a player to be able to practice their, throwing and their catching as if to emulate a feed. The wall can be moveable wall and rolled into a desired position for practice of bouncing a ball to oneself at any radius along the alley edge 202. It is anticipated that the throwing wall will be suspended via supports 906 from a set of wheels 902 and supporting structure 908 that will roll in a track 904. The wall 900 will be made of very dense and hard material allowing little to no absorbed energy from a lacrosse ball throw. Some examples may be pressboard with a Formica top, Corian, or stone. The moveable throwing wall will travel in a supporting track 904 which lies along the edge of an alley 102 or 202 for the majority of the distance of the alley so the player can practice his originating and receiving feeds anywhere in the alley.

Another mechanism is to have a moveable target 240 such as a small moveable wall as part of a range mechanism will allow a participant to practice passing to a moving target to simulate passing to a teammate. Also simulated is receiving a pass and then passing to the same or another teammate in an offensive advance. As the game of lacrosse requires constant movement, a moving target is desirable to hone the skills of passing. In addition, to practice "give and go" scenarios, a pass initiated by a machine then passed back to a moving target would sharpen the abilities of multiple pass exchanges between players. The moveable target 240 would be located along the edge of an alley 202 and could be controlled by electrical actuators to move in random or sequenced patterns.

The inventive range mechanism disperses balls in the alley to be retrieved and thrown back towards the goal or other target point to emulate ground ball situations. A sensing pad or set of pads 212 may be placed in the alley as a start point and will be used to reset the mechanism to start. The player, shown in position 210 of FIG. 2, could step on a sensing pad to allow the mechanism to reset, thereby releasing the next ball into the alley. The ball dispersing mechanism 230 shown in FIG. 2 will have controls that will disperse the ball at the required velocity (trajectory and rate) and direction (left and right) for random or controlled placement of the ball in the alley. A clock timer with alarms as part of video camera and control 220 can be used to pace players in the exercise.

A virtual goalie mechanism 250 may be used to emulate a goalie in the goal plane. This can be done by an electromechanical apparatus that tracks ball movement and moves accordingly or by a removable obstacle that can hone precision shots.

The playing surface of the alley or turf, 414 or 514 used for the range alley may be natural or synthetic. Synthetic is optimal as it is a covered structure and will have a long length of life. As natural turf requires continuous care and water and light for growth, it would be possible to create this environment in the structure but not optimal.

Various means of video recording shown in FIG. 2, both portable and permanent 220, can be combined with the lacrosse shooting range to provide individual instruction based on the practice session.

To make money off of the range, charges for the use of a lacrosse practice alley within a range can be by the hour, fractions or multiples thereof. Alternative charges methods for use of an alley may be number of balls.

Changes may be made within the purview of the appended claims without departing from the true scope and spirit of the invention in its broader aspects.

What is claimed is:

1. A system for providing practice to a player of shooting a lacrosse ball into a lacrosse goal comprising:

a plurality of alleys formed by partition of a polygon building structure, the alleys having sides and ends;

each alley having outer radius of about 64 feet, an inner radius of about 15 feet and being in the order of 36 degrees in arc; and a rotationally moveable goal located at a narrow end of the alley for presenting various angles of goal openings to a player shooting at the goal.

2. The system of claim 1 wherein the number of alleys within the structure is greater than 10.

3. The system of claim 1 wherein the goal has a ball return.

4. The system of claim 1 wherein the plurality of alleys are formed in multiple levels within the building structure.

5. The system of claim 1 wherein the inner radius is about 20 feet.

6. The system of claim 1 wherein the alleys have a throwing wall to provide throwing and catching practice to thereby emulate a ball feed from another player.

7. The system of claim 1 wherein the alleys have a video camera system for recording a player's actions.

8. The system of claim 7 wherein the video camera systems provide feedback and pacing for a player.

9. The system of claim 1 wherein the goal has a virtual goalie for defending the goal from a player.

10. The system of claim 1 wherein the goal has a ball dispersing mechanism for selectively feeding the bail to a player.

11. The system of claim 1 wherein the alleys have a set of sensing pads activated by a player for starting play and controlling placement of the lacrosse balls for player practice.

12. The system of claim 1 wherein the rotationally moveable goal has a radius great than 8 feet.

13. The system of claim 1 wherein the rotationally moveable goal is a worm drive, servo drive or rack and pinion drive.

14. The system of claim 3 wherein the ball return is centrally collected and returned any one of overhead return, underneath alley return or center alley return.

* * * * *